US005919600A

United States Patent [19]

Huang et al.

[11] Patent Number: 5,919,600

[45] Date of Patent: Jul. 6, 1999

[54] THERMAL WATERLESS LITHOGRAPHIC PRINTING PLATE

[75] Inventors: Jianbing Huang, Wood-Ridge, N.J.; S. Peter Pappas, Juno Beach, Fla.; Shashikant Saraiya, Parlin, N.J.; Thi Nguyen Do, West Orange, N.J.; Richard M. Goodman, Briarcliff Manor, N.J.

[73] Assignee: Kodak Polychrome Graphics, LLC, Norwalk, Conn.

[21] Appl. No.: 09/128,887

[22] Filed: Aug. 4, 1998

Related U.S. Application Data

[60] Provisional application No. 60/057,883, Sep. 3, 1997.

[51] Int. Cl.[6] ..... G03C 1/76

[52] U.S. Cl. ..... 430/272.1; 430/303; 430/944

[58] Field of Search ..... 430/272.1, 303, 430/944; 101/453, 457

[56] References Cited

U.S. PATENT DOCUMENTS

| | | | |
|---|---|---|---|
| 3,511,178 | 5/1970 | Curtin | 101/450 |
| 3,677,178 | 7/1972 | Gipe | 101/450 |
| 3,894,873 | 7/1975 | Kobayashi et al. | 96/33 |
| 3,933,495 | 1/1976 | Kondo et al. | 96/33 |
| 4,342,820 | 8/1982 | Kinashi et al. | 430/11 |
| 4,358,522 | 11/1982 | Fujita et al. | 430/166 |
| 4,775,607 | 10/1988 | Schlosser | 430/162 |
| 4,842,990 | 6/1989 | Herrmann et al. | 430/272 |
| 5,126,228 | 6/1992 | Higashi et al. | 430/303 |
| 5,232,813 | 8/1993 | Okuno et al. | 430/156 |
| 5,339,737 | 8/1994 | Lewis et al. | 101/454 |
| 5,353,705 | 10/1994 | Lewis et al. | 101/453 |
| 5,379,698 | 1/1995 | Nowak et al. | 101/453 |
| 5,487,338 | 1/1996 | Lewis et al. | 101/454 |
| 5,503,074 | 4/1996 | Hirano et al. | 101/456 |
| 5,721,087 | 2/1998 | Yokoya et al. | 430/303 |

FOREIGN PATENT DOCUMENTS

| | | | |
|---|---|---|---|
| 0 763 780 A2 | 3/1997 | European Pat. Off. | G03F 7/075 |

*Primary Examiner*—Janet Baxter
*Assistant Examiner*—Sin J. Lee

[57] ABSTRACT

A waterless or driographic printing plate which can be thermally imaged by an infrared laser is composed of a substrate; a thermal imaging layer containing a photothermal conversion material, such as an infrared absorbing material, and a thermoplastic polyurethane with pendent allyl groups; and a crosslinked silicone polymer top layer. It was discovered that when the imaging layer contains an allyl functional polyurethane mixed with an infrared absorbing dye or pigment, the polymeric layer will have enhanced solubility in certain solvents when exposed to infrared radiation. In addition, the polymeric layer continues to exhibit excellent adhesion to the silicone in unexposed areas so that the infrared absorbing layer can endure development with a suitable organic solvent, or a solvent mixture. Mild brushing or rubbing with the developing solvent readily removes laser-struck portions of the infrared imaging layer while unexposed areas remain firmly intact.

33 Claims, No Drawings

THERMAL WATERLESS LITHOGRAPHIC PRINTING PLATE

CROSS-REFERENCES TO RELATED APPLICATIONS

This application claims priority from Provisional Application U.S. Serial No. 60/057,883 filed Sep. 3, 1997.

BACKGROUND OF THE INVENTION

1. Field of the Invention

The present invention involves a waterless or driographic lithographic printing plate imageable by a laser emitting infrared or near-infrared radiation at a wavelength between 700 and 1500 nm.

2. Description of Related Art

Waterless printing plates have existed since 1970. Most waterless printing plates involve an ink abhesive layer such as silicone overlying a light absorbing imaging layer. Imaging is typically achieved by exposing the imaging layer to an ultraviolet radiation source then selectively removing the ink abhesive coating. For positive working waterless plates, the imaging layer is a light absorbing layer typically containing a negative working diazo resin as disclosed in U.S. Pat. Nos. 3,511,178; 3,677,178; and 4,775,607; or a light absorbing layer containing a photopolymerizable compound as described in U.S. Pat. Nos. 3,894,873; 5,232,813, and 5,503,074. For negative working waterless plates, imaging is achieved by solubilizing, via ultraviolet radiation, the imaging layer which typically contains diazonaphthoquinones, as described in U.S. Pat. Nos. 4,342,820 and 4,358,522; or imaging a layer that undergoes light-induced acid-catalyzed hydrolysis as described in U.S. Pat. No. 4,842,990. U.S. Pat. No. 3,933,495 describes a dual-tone waterless plate wherein the solubility of the imaging layer is either enhanced or reduced by the developer in the developing step, depending upon developer used.

The majority of the plate manufacturing processes described above require a photographic film, which is expensive and tedious to make. The recent drive for computer-to-plate (CTP) technologies has created the need to develop a new generation of waterless plates, if the advantages of waterless printing are to be maintained for CTP applications.

One method of adapting waterless plate making technology to CTP applications is to generate a contact mask on a photographic waterless plate. The mask could be produced, for example, via a digital device such as an ink jet printer, electrographic printer, or any other apparatus employing a digitally controlled laser. The mask could also be produced by laser ablation, laser ablative transfer, laser induced color change techniques in a photochromic top layer or in a laser-induced solubilized or insolubilized opaque top layer. However, masked printing plates are costly to manufacturing and require more complicated processing such as flood exposing and the removal of the mask.

U.S. Pat. No. 5,339,737 teaches physically transforming an infrared-absorbing layer by laser ablation using high doses of laser energy in order to remove the overlying silicone layer. However, this process is relatively time consuming. In order to circumvent the problem, U.S. Pat. No. 5,353,705 describes adding an ablatable, but non-infrared absorbing, layer, below the infrared absorbing layer. Another approach, taught in U.S. Pat. No. 5,379,698, involves using a metallic or metal oxide thin film as the imaging layer. Yet another approach is taught in U.S. Pat. No. 5,487,338 and involves using an infrared reflective layer situated below the infrared absorbing layer.

All of the above approaches, however, introduce additional cost to the manufacturing of CTP waterless printing plates. In addition, the debris produced during imaging of these printing plates generally requires an additional step and/or complicated devices to clean the plate subsequent to imaging. Despite the improvements made in the manufacture of CTP waterless printing plates, there continues to be a need for a more cost effective and efficient manufacture of high performance CTP waterless printing plates.

SUMMARY OF THE INVENTION

The present invention is a waterless printing plate imageable with minimal infrared energy that can be imaged free of debris. In particular the present invention is a dry planographic printing plate precursor element comprising;

A) a substrate;

B) a composite layer structure having an inner surface contiguous to the substrate and an outer surface, the composite layer structure comprising:

(a) a first layer applied to a surface of the substrate, the first layer consisting essentially of at least one photothermal conversion material and a thermoplastic polyurethane containing allyl groups; and (b) a silicone layer comprised of a cross-linked silicone polymer.

An added embodiment of this invention is a method for forming a planographic printing plate comprising the steps, in the order given:

I) providing a planographic printing plate precursor element comprising:

A) a substrate;

B) a composite layer structure having an inner surface contiguous to the substrate and an cuter surface, the composite layer structure comprising:

(a) a first layer applied to a surface of the substrate, the first layer consisting essentially of a thermoplastic polyurethane containing allyl groups, and at least one photothermal conversion material; and (b) a silicone layer comprised of a crosslinked silicone polymer;

II) imagewise exposing the composite layer structure to thermal energy to provide exposed portions and complimentary unexposed portions in the composite layer structure, wherein the exposed portions are selectively permeable to a developer liquid; and III) applying the developer liquid to the composite layer structure to remove the exposed portions to produce an imaged planographic printing plate having uncovered ink receptive areas and complimentary ink repellent areas of the silicone layer.

In a preferred embodiment of this invention the thermoplastic polyurethane containing allyl groups contains pendent allyl groups and is prepared by reacting a diisocyanate and a diol material containing at least one allyl functional diol, and the photothermal conversion material is an infrared absorbing material.

DETAILED DESCRIPTION OF THE INVENTION

This invention relates to an imaging element which can be imaged with thermal energy. More particularly, this invention relates to dry, thermal lithographic printing plates, which can be imaged by thermal energy typically by imagewise exposure with an infrared emitting laser, a laser emitting in the visible, or the like. A key aspect of the present invention lies in the discovery that when the imaging layer of the plate contains an allyl functional polyurethane mixed with an infrared absorbing dye or pigment, the polymeric layer will have enhanced solubility in certain solvents when exposed to infrared radiation. In addition, the polymeric layer will continue to exhibit excellent adhesion to the silicone in the unexposed areas. The infrared absorbing (thermal) layer of the present invention can therefore endure development with a suitable organic solvent, or a solvent mixture. Mild brushing or rubbing with the developing solvent will readily remove the laser-struck portion of the infrared sensitive layer while the unexposed area remains firmly intact.

Plate Construction

The plate construction of the present invention includes a composite layer structure supported by a substrate. The composite layer structure includes a silicone top layer overlying a first layer, hereinafter identified as a "thermal" layer having an inner surface contiguous to the substrate. Optionally, the construction may also include: (a) a protection layer atop the silicone layer, (b) an adhesion promotion layer between silicone and the thermal layer, and (c) a primer layer between the thermal layer and substrate.

Thermal Layer

The thermal layer is composed of a unique composition which consists essentially of at least one photothermal conversion material and an allyl functional polyurethane. Thus, two essential components of the thermal layer are: (i) an allyl functional polyurethane; and (ii) an photothermal conversion material. As used herein the tern "allyl functional polyurethane" is intended to mean a thermoplastic polyurethane containing allyl groups which may be either pendent or terminal allyl groups. As used herein the "photothermal conversion material" is a component which absorbs incident radiation and converts the radiation to thermal energy. Typically, the photothermal conversion material is an "infrared absorbing" compound. Optional ancillary ingredients such as non-absorbing colorants, print-out dyes, surfactants, and acid or base generators may also be added to the thermal layer for cosmetic reasons, quality control and/or to facilitate image inspections before or after development. The thermal layer hereinafter will be described as an "infrared absorbing layer" having an infrared absorbing composition with at least one "infrared absorbing material", but is not intended to be limited thereby.

The allyl functional polyurethane may be prepared, for example, by reacting a diisocyanate with an allyl functional diol. Mixtures of different diisocyanates and of different diols may be used to prepare the polyurethane with the proviso that at least one of the diols must contain at least one allyl group.

Useful allyl functional diols have the general formula:

$$HOCR^1{}_2—CR^2(OH)—CR^3{}_2—O—CR^4{}_2—CR^5{=}CR^6{}_2$$

where $R^1$–$R^6$ are individually selected from hydrogen or alkyl groups. Preferably, all R groups are hydrogen. Commercially available diols having an allyl groups include 3-allyloxy-1,2-propanediol and trimethylolpropane allyl ether. Other diols having an allyl ester group include allyl 4,4-bis-(hydroxyethyloxyphenyl)-pentanoate and allyl 2,2-bis(hydroxymethyl)propanoate. These allyl functional diols may be used alone or in combination; or further in combination with a diol not containing the allyl functionality. Examples of useful diols, not containing the allyl functionality, include ethylene glycol, polyethylene glycol, propylene glycol, polypropylene gylcol, neopentyl glycol, butanediol, and 2,2-bis(hydroxymethyl) propionic acid.

In making the allyl functional polyurethane both aromatic and aliphatic diisocyanates may be reacted with the diol or diol mixture. Examples of aromatic diisocyanates include 2,4-toluene diisocyanate, 2,6-toluene diisocyanate, p-xylene diisocyanate, m-xylene diisocyanate, tetramethylxylene diisocyanate, 4,4-diphenylmethane diisocyanate, 1,5-naphthalene diisocyanate, 3,3-dimethylbiphenyl-4,4-diisocyanate and the like. Examples of aliphatic diisocyanates are hexamethylene diisocyanate, trimethylhexamethylene diisocyanate, isophorone diisocyanate, 4-4-methylenebis(cyclohexyl isocyanate), methylcyclohexane-2,4-(or 2,6)-diisocyanate, 1,4-bis (isocyanatomethyl) cyclohexane and the like.

The allyl functional polyurethane also may be prepared by reacting a diisocyanate with a COOH functional diol such as dimethylol propionic acid, and then converting the COOH groups on the resulting polyurethane into allyl ester groups.

The other essential ingredient of the infrared absorbing layer is the infrared absorber which is selected from either a dye or pigment. A primary factor in selecting the infrared absorber is its extinction coefficient which measures the efficiency of the dye or pigment in absorbing infrared radiation in accordance with Beer's Law. Useful infrared absorbing compounds typically have a maximum absorption wavelength ($\lambda$max) in some part of the electromagnetic spectrum greater than about 750 nm, that is in the infrared region and near infrared region of the spectrum. More particularly, they must have high absorptivity in a part of the wavelength region from about 780 nm to about 1300 nm and typically from about 800 nm to about 1100 nm. Thus the extinction coefficient must have a sufficient value to efficiently absorb the infrared radiation exposure usually having wavelengths from 780 nm to 1300 nm. The infrared absorbing compounds can be dyes or pigments, and a wide range of compounds are well known in the art. Classes of materials that are useful include, but are not limited to, triarylamine, thiazolium, indolium, oxazolium, polyaniline, polypyrrole, polythiophene, squarilium, croconate, cyanine, phthalocyanine, merocyanine, chalcogenopyryloarylidine, bis(chalcogenopyryrlo)polymethine, oxyindolizine, quinoid, indolizine, pyrylium, and thiolene metal complexes (e.g. metal dithiolene) dyes and pigments. Other useful classes include thiazine, azulenium and xanthene dyes and dark inorganic pigments. Examples of infrared absorbing dyes useful in the present invention include, Cyasorb IR 99 and Cyasorb IR 165 (both available from Glendale Protective Technology), Epolite IV-62B and Epolite III-178 (both available from the Epoline Corporation), PINA-780 (available from the Allied Signal Corporation), SpectraIR 830A and SpectraIR 840A (both available from Spectra Colors Corporation). Examples of infrared absorbing pigments are Projet 900, Projet 860 and Projet 830 (all available from the Zeneca Corporation). Carbon black pigments may also be used. Carbon black pigments are particularly advantageous due to their wide absorption bands since such carbon black-based plates can be used with multiple infrared imaging devices having a wide range of peak emission wavelengths.

Other ingredients that optionally may be present in the infrared absorbing layer include dyes and acid or base generators for visible image readout.

Suitable dyes of this type include Solvent blue 35, Victoria pure blue BO, 4-(phenylazo)diphenylamine, ethyl orange, Pergascript Red I-6B (available from the Ciba-Geigy Corporation), and the like. Suitable acid generators include iodonium and sulfonium salts.

Silicone Layer

The silicone layer used in the present invention may be a crosslinked polydiorganosiloxane comprising the following repeating units:

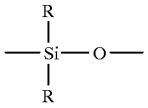

wherein each R is independently selected from a monovalent alkyl, aryl or alkenyl group, or a combination thereof. R may contain functional substituent groups such as hydroxyl, halogen, amino, alkoxy, aryloxy, (meth)acryloxy, and thiol. Preferably the R group is methyl which should be in the majority when a mixture of R groups is used. The silicone layer may optionally contain pigments and fillers such as silica, calcium carbonate, and titanium oxide. Adhesion promoters may also be added to the coating to improve silicone layer formation.

Polydiorganosiloxane networks may be formed, for example, by known crosslinking reactions such as the condensation of a silanol and acyloxy or alkoxy silanes, the addition of hydrosilane to alkenyl groups, and the photo-initiated polymerization of (meth)acrylate or epoxy groups; however, preferred are the condensation and addition methods.

For the condensation crosslinking method, a silanol terminated diorganosiloxane polymer, for example, may be reacted with polyacyloxy or polyalkoxy silane crosslinkers in the presence of a suitable catalyst. This reaction may be accelerated both by heat and moisture. For a better pot life during manufacturing, a silicone network may be formed via the self condensation between polydiorganosiloxane with trialkoxysilyl groups on both ends as is described in European Patent Application EP0763780A2. Catalysts suitable for this condensation are organic carboxylic acid salts of tin, zinc and other multivalent metals that are well known in the art. Adhesion promoters may also be included in this type of silicone coating formulation. Preferred adhesion promoters are aminosilanes, such as represented by the general formula $$R_mR'_nSi(OR'')_{4-m-n}$$

where R is unsubstituted or monosubstituted amino-alkyl, R' and R" are each alkyl or aryl, m is 1 or 2 and n is 0 or 1, m+n being equal to 1 or 2. Specific examples of such aminosilanes are γ-aminopropyltriethoxy silane and γ-[N-(2-aminoethyl)-amino]propyl trimethoxy silane.

Polydiorganosiloxanes crosslinked via addition reaction between hydrosilane and alkenyl groups may be prepared, for example, from a vinyl functional polydiorganosiloxane and methyl hydrosiloxane homopolymer or copolymer in the presence of a suitable catalyst. The alkenyl groups in the siloxane polymer may be randomly distributed along the polymeric chain, or located at the chain ends. The addition catalysts may be selected from known ones; however, preferred are elemental platinum, platinum chloride, chloroplatinic acid and platinum coordinated with olefins. To improve pot-life, volatile inhibitors such as ketones, alcohols and alkynes may be used. Particularly preferred are alkynes such as those disclosed in U.S. Pat. No. 4,184,006 the disclosure of which is incorporated herein by reference. Specific examples of such alkynes are 2-methyl-3-butyne-2-ol, ethynylcyclohexanol, 2-butyne, 2-methyl-but-1-en-3-yne, and phenyl acetylene.

Organic solvents may be used to facilitate film formation of the silicone layer. Suitable solvents include aliphatic and aromatic hydrocarbons, ketones, and esters. Specific examples of useful solvents are hexane, heptane, toluene, xylene, 2-butanone, and amyl acetate. The amount of solvents used primarily depends upon molecular weights of silicone starting materials, coating thickness and the coating application technique. Coating methods for applying silicone coatings are known in the art. Preferred coating methods for use in this invention include whirl coating, wire-wound bar coating, direct gravure coating, gravure-offset coating, liquid curtain coating, slit-extrusion coating, meniscus coating and the like. The coating weight of the silicone layer may be in the range between about 0.2 to about 10 $g/m^2$, and preferably in the range between about 1.0 to about 3.0 $g/m^2$.

Substrate

Substrates which may be used in the planographic plate of this invention may be any sheet material conventionally used to prepare lithographic printing plates. Suitable substrates include metals such as aluminum sheets; paper; paper coated on one or both sides with an α-olefin polymer such as polyethylene; films such as cellulose acetate film, polyvinyl acetal film, polystyrene film polypropylene film, polyester film such as polyethylene terephthalate film, polyamide film, polyimide film, nitrocellulose film, polycarbonate film, polyvinylchloride film; composite films such as polyester, polypropylene or polystyrene film coated with polyethylene film; metalized paper or films; metal/paper laminates; and the like. Such substrates may contain an antihalation compound or sub coatings.

A preferred substrate is an aluminum sheet. The surface of the aluminum sheet may be treated by metal finishing techniques known in the art including brush roughening, electrochemical roughening, chemical roughening, anodizing, and silicate sealing and the like. If the surface is roughened, the average roughness Ra is preferably in the range from 0.1 to 0.8 μm, and more preferably in the range from 0.1 to 0.4 μm. The preferred thickness of the aluminum sheet is in the range from about 0.005 inch to about 0.020 inch.

The surfaces of plastic films may be treated using the surface treatment techniques known in the art to improve adhesion between the substrate and organic coatings.

Optional Layers

The planographic printing plate of this invention may contain one or more ancillary layers to improve interlayer adhesion, to reduce halation effects, to improve printing surface characteristics, and the like. Optional layers that may be added to modify the essential plate construction include a protective layer laminated on top of silicone layer, an adhesion promotion layer between silicone and the infrared absorbing layer, and a primer layer between the radiation sensitive layer and the substrate.

An optional primer layer may be inserted between the infrared absorbing layer and substrate to, for example, prevent heat loss, especially when the substrate is a metal sheet, regulate ink receptivity, serve as a dye acceptor, if the developed plate needs to be dyed for visual image contrast enhancement, act as an adhesion promoter. The primer layer may be a thermoplastic coating, provided the coating is not soluble in the solvents employed to make the infrared absorbing layer. Examples of thermoset coatings include polyester-melamine coatings, acrylic melamine coatings, epoxy coatings, and polyisocyanate coatings. An example of a thermoplastic coating is polyvinyl alcohol. When cured by ultraviolet radiation, the primer layer may be prepared from free radical polymerizable coatings, cationic crosslinkable coatings catalyzed by photo generated acid, and diazo resin with suitable binders.

An optional adhesion promotion layer may be inserted between the silicone top layer and the infrared absorbing layer; preferred are aminosilanes of the general formula $$R_mR'_nSi(OR'')_{4-m-n}$$

where R is unsubstituted or mono-substituted amino-alkyl, R' and R" are each alkyl or aryl, m is 1 or 2 and n is 0 or 1, m+n being equal to 1 or 2. Specific examples of such aminosilanes are γ-aminopropyltriethoxy silane and γ-[N-(2-aminoethyl)amino propyl trimethoxy silane.

An optional protective layer may be laminated on top of silicone layer to protect the silicone surface during storage and handling. Typically the protective layer is a thin polymeric film including polyesters such as polyethylene terephthalate, polyolefins such as polyethylene and polypropylene, and the like. The protective layer is designed to be easily removed without damaging the silicone layer surface either prior to or during processing.

Plate Imaging and Processing

The waterless plate of the present invention is imaged by the method comprising the following steps. First a waterless plate precursor as described above is provided which is composed of, a substrate and a composite layer structure. The composite layer structure is further composed of a first thermal layer, e.g. an infrared absorbing layer, applied to a surface of the substrate and a silicone layer. The first thermal layer contains as essential components, a thermoplastic polyurethane containing pendent allyl groups and typically at least one photothermal conversion material, e.g. an infrared absorbing material. The silicone layer is comprised of a crosslinked silicone polymer. Next the composite layer structure is imagewise exposed to thermal energy to provide exposed portions and complimentary unexposed portions in the composite layer structure. As a result of the imaging exposure, the exposed portions become selectively permeable to a developer liquid. Finally, the developer liquid is applied to the composite layer structure to remove the exposed portions to produce an imaged planographic printing plate having uncovered ink receptive areas and complimentary ink repellent areas of the silicone layer. In a preferred embodiment of this invention, the photothermal conversion material is an infrared absorbing compound and imaging exposure is carried out with an infrared emitting laser.

The waterless plate of this invention and its methods of preparation have already been described above. This waterless plate may be imaged with a laser or an array of lasers emitting infrared radiation in a wavelength region that closely matches the absorption spectrum of the infrared absorbing layer. Suitable commercially available imaging devices include image setters such as a Creo Trendsetter (available from the CREO Corporation, British Columbia, Canada) and a Gerber Crescent 42T (available from the Gerber Corporation). Although the infrared absorbing layer of the composite layer structure is typically exposed through the silicone layer, the infrared absorbing layer may also be imaged through the substrate in those instances when the substrate is composed of a material which is transparent to infrared radiation, e.g., polyethylene terephthalate. When the silicone surface of the planographic printing plate is protected by a protective layer which is transparent to infrared radiation, the protective layer may remain in place during imaging exposure, or it may be removed. In either event, the protective layer typically is removed prior to development. Following the imaging step, the plate is then developed with a developer liquid.

When portions of the composite layer structure are exposed to infrared radiation, the exposed thermal layer portions therein selectively have enhanced solubility or dispersibility in a developer liquid. The developer liquid may be any liquid or solution which can both penetrate the silicone layer and selectively dissolve or disperse the reaction products without substantially affecting the unexposed areas of the infrared absorbing layer. Preferred developer solutions are those that contain polypropylene glycol ethers. A more preferred developer solution is tripropylene glycol n-butyl ether. The developer liquid may be diluted with a non-developing liquid. As used herein, the term non-developing liquid is intended to mean any liquid which does not penetrate the silicone layer and/or does not selectively dissolve or disperse the exposed areas. Non-developing liquids include liquids such as polypropylene glycol and aliphatic hydrocarbon solvents. Specific aliphatic hydrocarbon solvents are heptane and isoPar series solvents from Exxon Chemical Company.

Typically the developer liquid is applied to the imaged waterless plate by rubbing or wiping the silicone layer with an applicator containing the developer liquid. In the development operation the developer liquid penetrates the silicone layer and dissolves or disperses the imaged areas of the infrared absorbing layer and the wiping action physically removes the solubilized areas along with overlying areas of the silicone layer. Alternatively the imaged waterless plate may be brushed with the developer liquid or the developer liquid may be applied to the plate by spraying the silicone layer with sufficient force to remove the solubilized areas. In either instance a developed printing plate is produced which has uncovered areas which are ink receptive and complimentary areas of the silicone layer, not exposed to infrared radiation, which effectively are ink repellent. The developer liquid may be applied at room temperature or at elevated temperatures over the range from about 25° C. to about 50° C. Preferably, the developer is applied at a temperature between about 35° C. to about 40° C. After development is complete, the developer liquid remaining on the plate typically is removed with a non-developing cleaning liquid to avoid damage to the silicone layer in the non-exposed areas. Suitable cleaning liquids include aqueous surfactant solutions, polypropylene glycols and aliphatic hydrocarbon solvents.

The waterless laser-imageable printing plate of the present invention will now be illustrated by the following examples, but is not intended to be limited thereby.

EXAMPLE 1

Preparation of Polyurethane Solution (I)

98.2 g (0.393 mol) 4,4'-diphenylmethane diisocyanate was dispersed in 350 g dry 2-butanone at room temperature (ca. 25° C.) until a uniform milky dispersion was obtained. Then 51.8 g (0.393 mol) 3-allyloxypropane-1,2-diol was added to the flask at a rate such that the temperature of the mixture was maintained below 40° C. The mixture was stirred without external heating for two additional hours. Then 3 g 5% dibutyl tin dilaurate solution in dry 2-butanone was added also at a rate such that temperature of the mixture was maintained below 40° C. The mixture was stirred without external heating for two additional hours. Finally the reaction was driven to completion at 60° C. Completion of the reaction was indicated by the disappearance of NCO absorption bands in the infrared spectra. After filtration, the product solution contained 30% polyurethane resin and was slightly hazy.

EXAMPLE 2

Preparation of Polyurethane Solution (II)

98.0 g (0.392 mol) 4,4'-diphenylmethane diisocyanate was dissolved in 250 g dry 2-butanone at 60° C. Then a solution containing 34.1 g (0.258 mol) 3-allyloxypropane-1,2-diol, 17.9 g (0.134 mol) 2,2-bis(hydroxymethyl) propionic acid in 50 g 2-butanone and 50 gram N,N'-dimethylformamide premixed with 3 g 5% dibutyl tin dilaurate solution in dry 2-butanone was dropwise added to the flask at a rate such that the temperature of the mixture was maintained below 65° C. The mixture was stirred at 60° C. until the completion of the reaction as indicated by the disappearance of NCO absorption bands in the infrared spectra. The product solution containing 30% polyurethane resin was filtered through filter paper before use.

EXAMPLE 3

Preparation of Polyurethane Solution (III)

40.0 g (0.16 mol) 4,4'-diphenylmethane diisocyanate and 27.8 g (0.16 mol) of toluene 2,4-diisocyanate were dissolved in 239 g dry 2-butanone at 60° C. Then a solution containing 43.1 g (0.32 mol) 3-allyloxypropane-1,2-diol in 20 g of 2-butanone premixed with 1.3 g 5% dibutyl tin dilaurate solution in dry 2-butanone was dropwise added to the flask at a rate such that the temperature rise due to the exotherm of the reaction was controlled below 5 degree, viz. the temperature of the mixture was maintained below 65° C. The mixture was stirred at 60° C. until the completion of the reaction as indicated by the disappearance of NCO absorption bands in the infrared spectra. The product solution containing 30% polyurethane resin was filtered through filter paper before use.

EXAMPLE 4

Preparation of Polyurethane Solution (IV)

98.0 g (0.392 mol) 4,4'-diphenylmethane diisocyanate was dissolved in 250 g dry 1,4-dioxane at room temperature. Then a solution containing 52.5 g (0.134 mol) 2,2-bis (hydroxymethyl) propionic acid in 100 g 1,4-dioxane premixed with 3 g 5% dibutyl tin dilaurate solution in dry 2-butanone was dropwise added to the flask at a rate such that the temperature of the mixture was maintained below 35° C. The mixture was stirred without external heating for two additional hours. Finally, the reaction was driven to completion at 60° C. Completion of the reaction was indicated by the disappearance of NCO absorption bands in the infrared spectra. The product solution contained 30% polyurethane resin.

EXAMPLE 5

To an aluminum sheet prepared using brush roughening, anodic oxidation and silicate treatments was applied the following solution on a whirl coater spinning at 80 rpm:

| Component | Parts by weight |
|---|---|
| Polyurethane Solution (I) (Example 1) | 10.00 |
| SpectraIR 830A[1] | 0.34 |
| Solvent Blue 35[2] | 0.07 |
| 2-butanone | 80.00 |

[1]SpectraIR 830A is an infrared absorbing dye available from Spectra Colors Corporation.
[2]Solvent Blue 35 is a dye available from Spectra Colors Corporation.

After drying at 110° C. for 2 minutes, a silicone coating was applied by a whirl coater also spinning at 80 rpm. The silicone coating was made up of the following:

| Component | Parts by weight |
|---|---|
| PS 225[3] | 2.0 |
| SL 6020[4] | 0.2 |
| SL 6040[5] | 0.06 |
| PC 075[6] | 0.06 |
| IsoPar E[7] | 70.0 |

[3]PS225 is a silicone gum with randomly distributed vinyl groups along a polydimethyl siloxane main chain from United Chemical.
[4]SL6020 is a hydromethyl siloxane polymer, a product of GE Silicones.
[5]SL6040 is a volatile inhibitor product of GE Silicones.
[6]PC075 is a platinum complex from United Chemicals.
[7]IsoPar E is an isoparafin solvent from Exxon Chemical.

The silicone coating was cured at 125° C. for 2 minutes. The resulting plate was then imaged by a Creo Trendsetter at 120 mJ/cm$^2$ (laser power: 8.5 W/cm$^2$; drum speed: 155 rpm). The laser image was barely visible. The imaged plate was rubbed with a soft pad soaked with tripropylene glycol n-butyl ether (Dowanol TPNB, available from Dow Chemical Company) until the silicone layer and the polyurethane layer in the laser struck area were completely removed. The developed plate was immediately washed with a surfactant solution containing 5 wt % Pelex NBL (sodium n-butyl naphthalene sulfonate from High Point Chemical Corporation). The plate was tested on an R & P H-125 sheet-fed press with Sun Chemical Drilith ink "H" cyan (available from Sun Chemical Corporation) in the absence of fountain solution in the dampening system. More than 20,000 good quality impression were obtained.

EXAMPLE 6

Example 5 was repeated with the exception that polyurethane solution II (Example 2) was used in place of the polyurethane solution I. The resulting plate was then imaged by a Creo Trendsetter at 200 mJ/cm$^2$ (laser power: 8.5 W/cm$^2$; drum speed: 93.1 rpm). The laser image was slightly visible. The imaged plate was rubbed with a soft pad soaked with tripropylene glycol n-butyl ether (Dowanol TPNB) until the silicone layer and the polyurethane layer in the laser struck area was completely removed. The developed plate was immediately washed with a surfactant solution containing 5 wt % Pelex NBL (sodium n-butyl naphthalene sulfonate, available from High Point Chemical Corporation). The plate contained high resolution images with exposed aluminum oxide as the ink-receptive image area surrounded by a durable silicone surface as the ink-repelling non-image area.

EXAMPLE 7

Example 5 was repeated except that Epolite III-178 (available from Epoline Corporation) was substituted for SpectraIR 830A used in Example 5 and Solvent Blue 35 was omitted. The resulting plate was then imaged by a Gerber Crescent 42T at 220 mJ/cm$^2$. The laser image was barely visible, but was developed fully when the plate was rubbed with a soft pad soaked with Dowanol TPNB. The developed plate was immediately washed with a surfactant solution containing 5 wt % Pelex NBL (sodium n-butyl naphthalene sulfonate). The plate contained high resolution images with exposed aluminum oxide as the ink-receptive image area surrounded by a durable silicone surface as the ink-repelling non-image area.

EXAMPLE 8

Example 5 was repeated except that the following silicone coating was used:

| Component | Parts by weight |
|---|---|
| PS 445[8] | 2.0 |
| SL 6020 | 0.2 |
| SL 6040 | 0.06 |
| PC 075 | 0.06 |
| IsoPar E | 70.0 |

[8]PS445 is a vinyl terminated polydimethylsiloxane from United Chemical.

The silicone coating was cured at 125° C. for 2 minutes. The resulting plate was then imaged by a Creo Trendsetter at 200 mJ/cm$^2$ (laser power: 8.5W/cm$^2$; drum speed; 93.1 rpm). The laser image was slightly visible. The imaged plate was rubbed with a soft pad soaked with tripropylene glycol n-butyl ether (Dowanol TPNB) until the silicone layer and the polyurethane layer in the laser struck area was completely removed. The developed plate was immediately washed with a surfactant solution containing 5% Pelex NBL (sodium n-butyl naphthalene sulfonate). The plate contained high resolution images with exposed aluminum oxide as the ink-receptive image area surrounded by a durable silicone surface as the ink-repelling non-image area.

EXAMPLE 9

To an aluminum sheet prepared using brush roughening, anodic oxidation and silicate treatments was applied the following solution on a whirl coater spinning at 80 rpm

| Component | Parts by weight |
|---|---|
| Polyurethane Solution (I) (Example 1) | 10.00 |
| SpectraIR 830A | 0.34 |
| 2-butanone | 80.00 |

After drying at 110° C. for 2 minutes, the IR absorbing layer was first coated with 0.50% 3-aminopropyl triethoxy silane in isoPar E on a whirl coater spinning at 80 rpm, and then coated using the same coating technique with the following silicone solution:

| Component | Parts by weight |
|---|---|
| PS 345.5[9] | 5.0 |
| Ethyl triacetoxy silane | 0.25 |
| Dibutyl tin diacetate, 4 wt % in isoPar E | 0.25 |
| IsoPar E | 95.0 |

[9]PS 345.5 is a silanol terminated polydimethyl siloxane available from United Chemicals.

The silicone coating was cured at 125° C. for 4 minutes. The resulting plate was then imaged by a Creo Trendsetter at 200 mJ/cm$^2$ (laser power: 8.5 W/cm$^2$; drum speed: 93.1 rpm). The laser image was slightly visible. The imaged plate was rubbed with a soft pad soaked with tripropylene glycol n-butyl ether (Dowanol TPNB) until the silicone layer and the polyurethane layer in the laser struck area were completely removed, whereas the rest of the silicone coating remained intact. The developed plate was immediately washed with a surfactant solution containing 5 wt % Pelex NBL (sodium n-butyl naphthalene sulfonate). The plate contained high resolution images with exposed aluminum oxide as the ink-receptive image area surrounded by a durable silicone surface as the ink-repelling non-image area.

EXAMPLE 10

Example 5 was repeated with the exception that Polyurethane Solution III (Example 3) was used in place of the Polyurethane Solution I. The resulting plate was then imaged by a Creo Trendsetter at 200 mJ/cm$^2$ (laser power: 8.5 W/cm$^2$; drum speed: 93.1 rpm). The laser image was slightly visible. The imaged plate was rubbed with a soft pad soaked with tripropylene glycol n-butyl ether (Dowanol TPNB) until the silicone layer and the polyurethane layer in the laser struck area were completely removed. The developed plate was immediately washed with a surfactant solution containing 5 wt % Pelex NBL (sodium n-butyl naphthalene sulfonate). The plate contained high resolution images with exposed aluminum oxide as the ink-receptive image area surrounded by a durable silicone surface as the ink-repelling non-image area.

EXAMPLE 11

Preparation of Polyurethane Powder (V)

51 g N-methyl pyrrolidone and 204 g dry acetone was mixed in a 500 ml flask fitted with a mechanical stirrer and a nitrogen purge. 63.7 g (0.250 mol) 4,4'-diphenylmethane diisocyanate was added and the mixture was heated to 60° C. The solution became clear at 50° C. At 60° C. 45.7 g (0.263 mol) trimethylol-propane allyl ether was added over a period of one hour. After two and one half hours, 0.55 g of 5% solution of dibutyl tin dilaurate in dry 2-butanone was added. After an additional one and one half hours, the reaction mixture was cooled to room temperature and poured into 5 kg ice/water mixture (1:3 by weight). The precipitated polyurethane was collected and dried at room temperature to produce Polyurethane Powder (V).

EXAMPLE 12

Example 5 was repeated with the exception that 3.0 g dry Polyurethane Powder V (Example 11) was used in place of the Polyurethane Solution I. The resulting plate was then imaged by a Creo Trendsetter at 200 mJ/cm$^2$ (laser power: 8.5 W/cm$^2$; drum speed: 93.1 rpm). The laser image was slightly visible. The imaged plate was rubbed with a soft pad soaked with tripropylene glycol n-butyl ether (Dowanol TPNB) until the silicone layer and the polyurethane layer in the laser struck area were completely removed. The developed plate was immediately washed with a surfactant solution containing 5 wt % Pelex NBL (sodium n-butyl naphthalene sulfonate, available from High Point Chemical Corporation). The plate contained high resolution images with exposed aluminum oxide as the ink-receptive image area surrounded by a durable silicone surface as the ink-repelling non-image area.

EXAMPLE 13–16

The waterless plate of Example 5 was imaged by a Creo Trendsetter at 200 mJ/cm$^2$ (laser power: 8.5 W/cm$^2$; drum speed: 93.1 rpm) and then developed with the developers shown in the table below:

| EX | DEVELOPER |
|---|---|
| 13 | 200 g polypropylene glycol[10] (mol. wt. 725) and 100 g Surfadone LP 300[11] |
| 14 | 200 g isoPar V[12] and 100 g Surfadone LP 300[11] |

-continued

| EX | DEVELOPER |
|---|---|
| 15 | 400 g polypropylene glycol[10] (mol. Wt. 725) and 100 g ethanol |
| 16 | tripropylene glycol methyl ether (Dowanol TPM, available from Dow Chemical) |

[10]The polypropylene glycol is available from Aldrich Chemical.
[11]Surfadone LP 300 is N-dodecyl pyrrolidone, available from International Specialty Products.
[12]IsoPar V is an isoparafin solvent from Exxon Chemical Company.

The developed plates were immediately washed with a surfactant solution containing 5 wt % Pelex NBL (sodium n-butyl naphthalene sulfonate). These plates contained high resolution images with exposed aluminum oxide as the ink-receptive image area surrounded by a durable silicone surface as the ink-repelling non-image area.

EXAMPLE 17–20

(COMPARATIVE)

To demonstrate the importance of selecting a suitable developer, the waterless plate of Example 5 was imaged by a Creo Trendsetter at 200 mJ/cm$^2$ laser power: 8.5; drum speed: 93.1 rpm) and then developed with the following comparative developers shown in the table below:

| EX | DEVELOPER | RESULTS |
|---|---|---|
| 17 | PE 400 (polyethylene glycol from Union Carbide) | imaged area developed, but silicone in non-image area was damaged. |
| 18 | polypropylene glycol (mol. wt. 725) | silicone and IR absorbing layers remained attached to substrate in the laser struck area. |
| 19 | ethanol | silicone and IR absorbing layers were washed away in the laser struck and non-struck areas. |
| 20 | 200 g polypropylene glycol (mol. Wt. 725) and 100 g 2-methoxy propanol | imaged area developed but silicone in non-image area was damaged. |

EXAMPLES 21–26

(COMPARATIVE)

Example 5 was repeated with the exception that Polyurethane Solution IV was used in place of the Polyurethane Solution I. The resulting plate was then imaged by a Creo Trendsetter at 200 mJ/cm$^2$ (laser power: 8.5; drum speed: 93.1 rpm). The silicone coating in the laser struck area became less glossy. The table below summarizes the results:

| EX | DEVELOPER | RESULTS |
|---|---|---|
| 21 | Dowanol TPNB | Silicone and IR absorbing layers remained attached to substrate in the laser struck area. Excessive rubbing resulted in damage of silicone coating in laser non-struck area. |

-continued

| EX | DEVELOPER | RESULTS |
|---|---|---|
| 22 | Dowanol TPM | Silicone and IR absorbing layers remained attached to substrate in the laser struck area. |
| 23 | ethanol | Silicone and IR absorbing layers were washed away in the laser struck and non-struck areas. |
| 24 | 200 g polypropylene glycol (mol. Wt. 725) and 100 g Surfadone LP 300 | The IR-absorbing layer in laser struck or non-struck areas remained undissolved; silicone removed slightly faster in the laser struck area than in non-struck area. |
| 25 | 200 g isoPar V and 100 g Surfadone LP 300 | The IR-absorbing layer in laser struck or non-struck areas remained undissolved; silicone removed in the laser struck area, but silicone in non-struck area was partially damaged. |
| 26 | 400 g polypropylene glycol (mol. wt. 725) and 100 g ethanol | The IR-absorbing layer in laser struck or non-struck areas remained undissolved; silicone removed slightly faster in the laser non-struck area than in struck area. |

EXAMPLE 27

Example 5 was repeated except that the silicone and underlying layer in the laser struck areas were removed using a Toray Model TWL 860KII processor (available from Toray Industries, Inc.) which was modified by filling the soak section and brush section with tripropylene glycol n-butyl ether, and the dye section with 1 wt. % aqueous solution of Plex NBL. In this processor, the laser imaged printing plate travels through the soak section, then the brush section, and finally through the dye section. When the soak temperature was set at 38° C., the brush temperature at 32° C., and the plate traveled at 2 ft/min, a high quality printing plate was obtained where 2%–98% half tone dots at 150 lines per inch were resolved.

Those skilled in the art having the benefit of the teachings of the present invention as hereinabove set forth, can effect numerous modifications thereto. These modifications are to be construed as being encompassed within the scope of the present invention as set forth in the appended claims.

What is claimed is:

1. A dry planographic printing plate precursor element comprising:

A) a substrate;

B) a composite layer structure having an inner surface contiguous to the substrate and an outer surface, the composite layer structure comprising:

(a) a first layer applied to a surface of the substrate, the first layer consisting essentially of at least one photothermal conversion material and a thermoplastic polyurethane containing allyl groups; and (b) a silicone layer comprised of a crosslinked silicone polymer.

2. The element of claim 1 wherein the thermoplastic polyurethane contains pendent allyl groups and is prepared by reacting a diisocyanate and a diol material containing at least one allyl functional diol.

3. The element of claim 2 wherein the diisocyanate is an aryl diisocyanate.

4. The element of claim 3 wherein the aryl diisocyanate is one or more compounds selected from the group consisting of 2,4-toluene diisocyanate; 2,6-toluene diisocyanate; p-xylene diisocyanate; m-xylene diisocyanate; tetramethylxylene diisocyanate; 4,4'-diphenylmethane diisocyanate; 1,5-naphthalene diisocyanate; and 3,3'-dimethylbiphenyl-4,4'-diisocyanate.

5. The element of claim 3 wherein the aryl diisocyanate is 4,4'- diphenyl-methane diisocyanate.

6. The element of claim 2 wherein the diisocyanate is an alkyl diisocyanate.

7. The element of claim 6 wherein the alkyl diisocyanate is one or more compounds selected from the group consisting of hexamethylene diisocyanate; trimethylhexamethylene diisocyanate; isophorone diisocyanate; 4-4'-methylenebis (cyclohexyl isocyanate); methylcyclohexane-2,4-diisocyanate;

8. The element of claim 2 wherein 70% or more of the diol material is the allyl functional diol.

9. The element of claim 2 wherein the allyl functional diol is represented by the following formula:

$$HOCR^1{}_2—CR^2(OH)—CR^3{}_2—O—CR^4{}_2—CR^5{=}CR^6{}_2$$

wherein $R^1$, $R^2$, $R^3$, $R^4$, $R^5$, and $R^6$ are each individually a hydrogen atom or an alkyl group containing 1 to 4 carbon atoms.

10. The element of claim 2 wherein the allyl functional diol is 3-allyloxypropane-1,2-diol; trimethylolpropane allyl ether; or a combination thereof.

11. The element of claim 2 wherein the allyl functional diol is allyl 4,4-bis-(hydroxyethyloxyphenyl)pentanoate; allyl 2,2-bis(hydroxymethyl)propanoate; or a combination thereof.

12. The element of claim 2 wherein the diol material contains one or more non-allyl functional diol compounds.

13. The element of claim 1 wherein the photothermal conversion material is an infrared absorbing material.

14. The element of claim 13 wherein the infrared absorbing material is a dye, a pigment or a combination thereof having an absorption band in the region between 700 nm and 1400 nm.

15. The element of claim 13 wherein the infrared absorbing material is a dye or pigment of the type selected from the group consisting of triarylamine, thiazolium, indolium, oxazolium, polyaniline, polypyrrole, polythiophene, thiolene metal complexes, squarilium, croconate, cyanine, phthalocyanine, merocyanine, chalcogenopyryloarylidine, bis(chalcogenopyrylo)polymethine, oxindolizine, quinoid, indolizine, pyrylium, thiazine, azulenium, xanthene, carbon black, and dark inorganic pigments.

16. The element of claim 1 wherein the crosslinked silicone polymer is the reaction product of a vinyl functional polysiloxane copolymer and a polymer or copolymer of methyl hydrosiloxane.

17. The element of claim 1 wherein the substrate is an aluminum sheet.

18. The element of claim 1 wherein a primer layer is between the substrate and the composite layer structure.

19. The element of claim 1 wherein an adhesion promotion layer is between the first layer and the silicone layer.

20. The element of claim 1 wherein a removable protective layer is laminated to the silicone layer.

21. A method for forming a planographic printing plate comprising the steps, in the order given:

I) providing a planographic printing plate precursor element comprising:

A) a substrate;

B) a composite layer structure having an inner surface contiguous to the substrate and an outer surface, the composite layer structure comprising:

(a) a first layer applied to a surface of the substrate, the first layer consisting essentially of a thermoplastic polyurethane containing allyl groups, and at least one photothermal conversion material; and (b) a silicone layer comprised of a crosslinked silicone polymer;

II) imagewise exposing the composite layer structure to thermal energy to provide exposed portions and complimentary unexposed portions in the composite layer structure, wherein the exposed portions are selectively permeable to a developer liquid; and III) applying the developer liquid to the composite layer structure to remove the exposed portions to produce an imaged planographic printing plate having uncovered ink receptive areas and complimentary ink repellent areas of the silicone layer.

22. The method of claim 21, wherein the photothermal conversion material is an infrared absorbing compound; and wherein the imagewise exposing is carried out with an infrared emitting laser.

23. The method of claim 21, wherein a removable protective layer is laminated to the silicone layer and wherein the removable protective layer is removed from the silicone layer before step (III).

24. The method of claim 21, wherein the developer liquid comprises a propyleneglycol ether.

25. The method of claim 24, wherein the propyleneglycol ether is tripropyleneglycol-n-butyl ether.

26. The method of claim 24, wherein the developer liquid is diluted with a non-developing liquid.

27. The method of claim 26, wherein the non-developer liquid is polypropylene glycol, aliphatic hydrocarbon solvents, or a combination thereof.

28. The method of claim 21, wherein the developer liquid is applied to the composite layer structure by wiping or rubbing the silicone layer with an applicator containing the developer liquid.

29. The method of claim 21, wherein the developer liquid is applied to the composite layer structure by soaking in the developer liquid and then wiping or rubbing the silicone layer with an applicator containing a developer liquid.

30. The method of claim 21, wherein the developer liquid is applied to the composite layer structure at a temperature between about 25° C. to about 50° C.

31. The method of claim 21, wherein the developer liquid is applied to the composite layer structure at a temperature between about 35° C. to about 40° C.

32. The method of claim 21, wherein after step (III) the imaged planographic printing plate is cleaned by applying a non-developing cleaning liquid to the uncovered ink receptive areas and complimentary ink repellent areas.

33. The method of claim 32, wherein the non-developing cleaning liquid is an aqueous surfactant solution, a polypropylene glycol, or a hydrocarbon solvent.

* * * * *